US005139107A

United States Patent [19]

Nagai

[11] Patent Number: 5,139,107

[45] Date of Patent: Aug. 18, 1992

[54] EXHAUST MUFFLER FOR INTERNAL COMBUSTION ENGINES

[75] Inventor: Noboru Nagai, Tokyo, Japan

[73] Assignee: Kioritz Corporation, Tokyo, Japan

[21] Appl. No.: 625,967

[22] Filed: Dec. 11, 1990

[51] Int. Cl.[5] ..... F01N 3/00

[52] U.S. Cl. ..... 181/240; 181/258; 55/518

[58] Field of Search ..... 181/240, 256, 258, 264; 55/518

[56] References Cited

U.S. PATENT DOCUMENTS 3,526,294 9/1970 Bjork ..... 181/240
4,370,855 2/1983 Tuggle ..... 181/240
4,418,790 12/1983 Agnew ..... 181/268
4,890,690 1/1990 Fischer et al. ..... 181/240

*Primary Examiner*—L. T. Hix
*Assistant Examiner*—Eddie C. Lee
*Attorney, Agent, or Firm*—Bauer & Schaffer

[57] ABSTRACT

An internal combustion engine exhaust muffler formed to be dividable and integratable wherein an exhaust gas introducing tube and a pair of supporting pillars positioned substantially parallelly on both sides of the exhaust gas introducing tube are arranged within the exhaust muffler and a tubular member holding a cloth-like catalyst between holding screens is deformed to be substantially elliptically tubular and is hung over the pair of supporting pillars so as to enclose the exhaust gas introducing tube.

1 Claim, 3 Drawing Sheets

EXHAUST MUFFLER FOR INTERNAL COMBUSTION ENGINES

FIELD OF THE INVENTION

This invention relates to an exhaust muffler for such internal combustion engine as an air-cooled two-cycle gasoline engine used for such small power euipment as a grass trimmmer or a chain saw. Background of the Invention:

In a two-cycle gasoline engine or the like for such small power equipment as is mentioned above, the exhaust gas is delivered to an exhaust muffler out of an exhaust port of a cylinder, is silenced there and is discharged out.

Now, it is known to utililze an oxidizing catalyst in order to reduce HC (hydrocarbon), CO (carbon monoxide) and so one in the exhaust gas of such internal combustion engine as a two-cycle gasoline engine. The oxidizing catalyst is provided as a form of deposition on a cloth-like substrate (cloth catalyst).

Therefore, it is attempted to provide the above mentioned cloth-like catalyst within the above mentioned muffler to not only silence but also clean the exhaust gas.

However, in such case, as the strength of said cloth-like catalyst is comparatively low, in providing said cloth catalyst within the exhaust muffler, it will be necessary to support the cloth catalyst so as to be endurable in the strength to the exhaust gas energy which is in a pulsating flow high in the flow velocity without having the contact area greatly impaired and, as carbon and tar contained in the exhaust gas will be deposited on said cloth catalyst, it will be desired that said cloth catalyst can be easily fitted and removed and can be simply cleaned and replaced. However, an exhaust muffler satisfying these requirements has not been provided.

The first object of the present invention is to provide an internal combustion engine exhaust muffler which is provided with a cloth catalyst and can clean the exhaust gas. The second object of the present invention is to provide an exhaust muffler which can support the above mentioned cloth catalyst so as to be endurable in the strength to the exhaust gas energy without having the contact area greatly impaired. The third object of the present invention is to provide an exhaust muffler easy to fit and remove and simple to clean and replace. The fourth object of the present invention is to provide a simple and cheap internalcombustion engine exhaust muffler structure.

For these objects, according to the present invention, an exhaust muffler is formed to be dividable and integratable, an exhaust gas introducing tube and a pair of supporting pillars positioned substantially parallelly on both sides of thr exhaust gas introducing tube are arranged within the exhaust muffler and a tubular member comprising a cloth catalyst held between holding screens is deformed to be substantially elliptically tubular and is hung over the above mentioned pair of supporting pillars so as to enclose said exhaust gas introducing tube.

According to the present invention, a tubular member comprising a cloth catalyst held between holding screens is deformed to be substantially elliptically tubular and is hung over a pair of supporting pillars positioned substantially parallelly on both sides of an exhaust gas introducing tube so as to enclose the exhaust gas introducing tube, therefore, after all, the above mentioned cloth catalyst is arranged so as to enclose the exhaust gas introducing tube and there is an advantage that the exhaust gas introduced from the exhaust gas introducing tube will pass through the cloth catalyst so as to be cleaned.

The cloth catalyst is held between the holding screens, is therefore reinforced by these holding screens while taking the contact area with the exhaust gas to be large and has an advantage of being well endurable in the strength to the exhaust gas.

Also, the above mentioned tubular member will be supported on said pair of supporting pillars by the restoring force by the elastic deformation of the holding screens. Therefore, the above mentioned tubular member is very easy to fit and remove and is simple to clean and replace. That is to say, there is an advantage that the cloth catalyst can be very easily fitted, removed, cleaned and replaced together with said tubular member.

Further, as the above mentioned tubular member is supported by a pair of supporting pillars as described above, it is not necessary to provide any other particular fastening part or the like in order to fit the above mentioned tubular member and there is an advantage that the structure is simple and the cost is low.

Furthermore, said tubular member can be simply made, for example, by spirally rolling a metal screen inserting a cloth catalyst between the first lap and second lap, makinng the whole substantially cylindrical and jointing said screen at the ends and may be hung over a pair of supporting pillars as described above and therefore has an advantage of being easy to make.

DETAILED DESCRIPTION OF THE INVENTION

Figure 1:
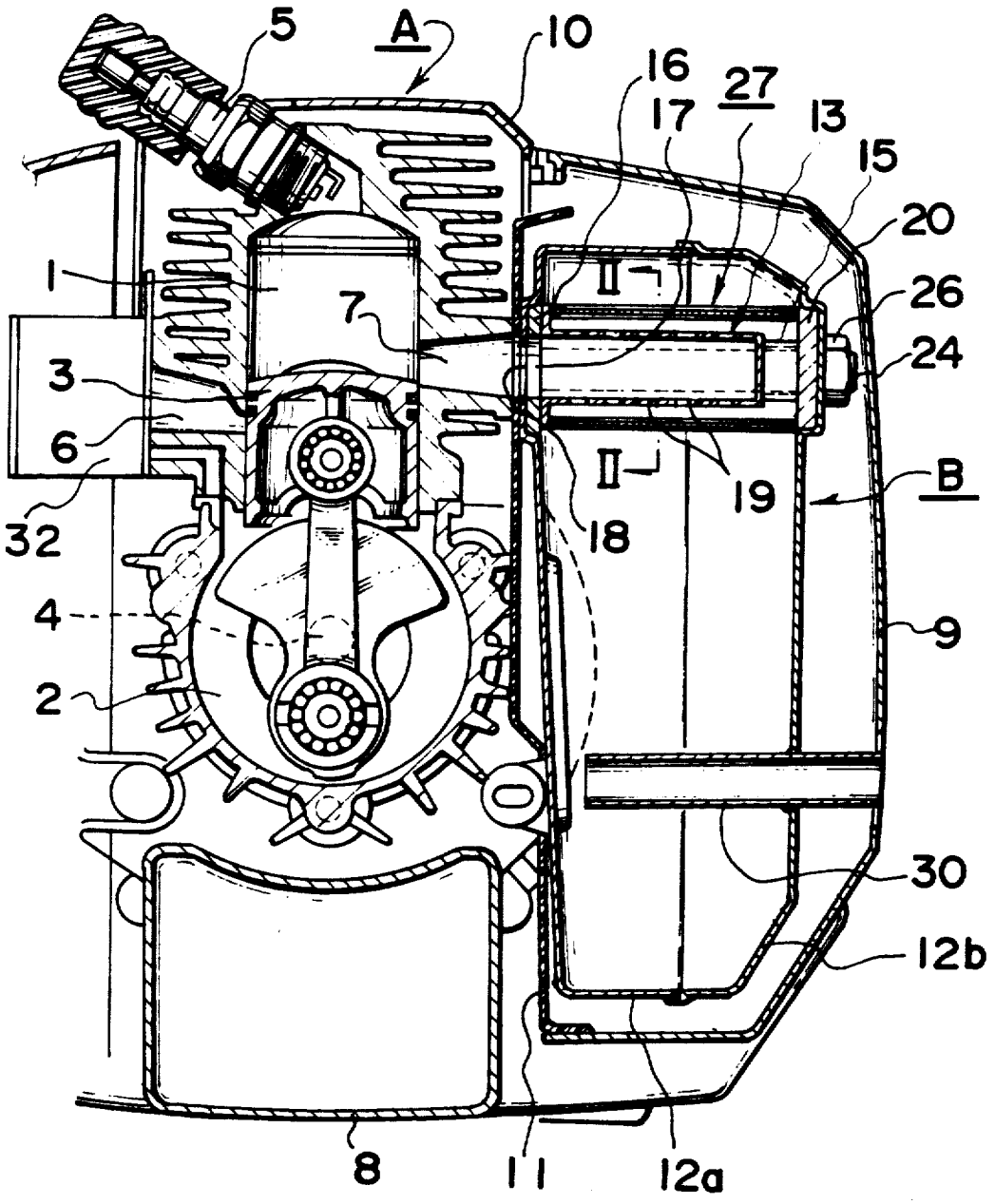
FIG. 1 is a vertically sectioned view showing an exhaust muffler embodying the present invention as fitted to an engine body.

The present invention shall be explained in detail in the following on the basis of the embodiment shown in the drawings.

As shown in FIG. 1, the body A of an engine comprises a cylinder 1, crankcase 2, piston 3, crankshaft 4 and ignition plug 5. Said cylinder 1 comprises a suction port 6 communicating with a carbureter 32 and air cleaner (not illustrated) and an exhaust port 7 connected with an exhaust muffler B relating to an embodiment of the present invention.

Also, in FIG. 1, the reference numeral 8 represents a fuel tank and 9 represents an exhaust muffler cover removably fixed to a cylinder cover 10 side. Further, between the above mentioned engine body A and fuel tank 8 and the exhaust muffler B, a heat insulating plate 11 is provided as a cooling wind guide so that the heat of said exhaust muffler B may not be transmitted to the engine body A and fuel tank 8 side.

The above mentioned exhaust muffler B relating to an embodiment of the present invention is formed as follows.

That is to say, the above mentioned exhaust muffler B is like a box press-molded of a steel sheet as a whole and is vertically divided into two parts of an inside exhaust muffler piece 12*a* on the above mentioned engine body A side and an outside exhaust muffler piece 12*b* on the above mentioned exhaust muffler cover 9 side so as to be dividable and integrally sealable.

An exhaust gas introducing tube 13 and a pair of supporting tubes 14 and 15 positioned substantially parallelly on both sides of the exhaust gas introducing tube 13 are arranged within the exhaust muffler.

The above mentioned exhaust gas introducing tube 13 is secured to an inside reinforcing plate 16 secured to the inside of the inside exhaust muffler piece 12*a* on said engine body A side. Said inside reinforcing plate 16 and inside exhaust muffler piece 12*a* are provided respectively with communicating holes 17 and 18 communicating with the interior of the above mentioned exhaust gas introducing tube 13 so as to communicate with the above mentioned exhaust port 7. The above mentioned exhaust gas introducing tube 13 is provided on the peripheral wall with many small holes 19 so as to communicate with the inside and outside.

Figure 3:
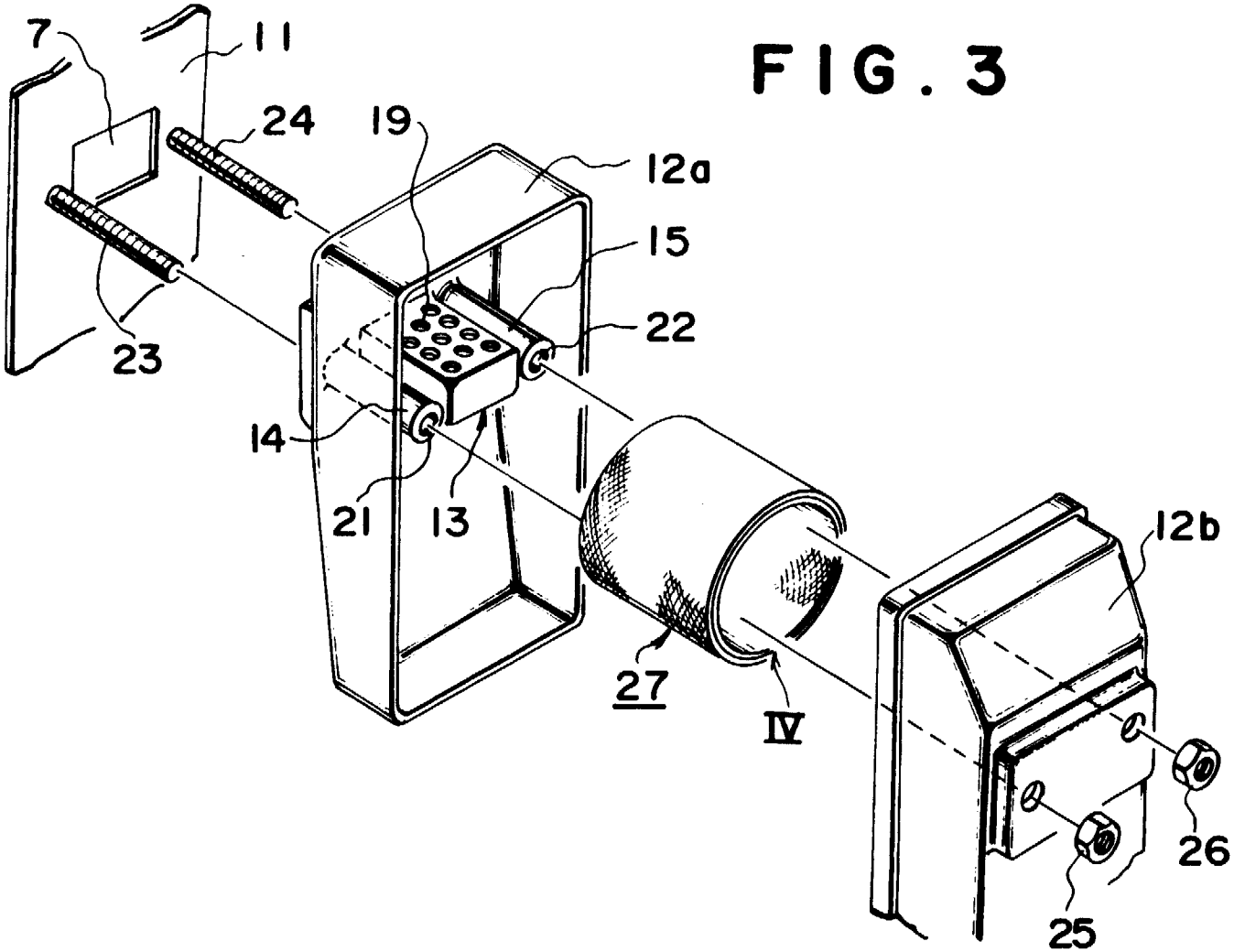
FIG. 3 is a perspective expanded view of the above mentioned exhaust muffler.

The above mentioned supporting pillars 14 and 15 are also secured to the above mentioned inside reinforcing plate 16 and are to support a later described tubular member 27 but will act to strongly integrate the above mentioned exhaust muffler pieces 12*a* and 12*b* while preventing them from being collapsed in the case of the illustrated embodiment. That is to say, the supporting pillars 14 and 15 are formed to be respectively of such lengths that, when said exhaust muffler pieces 12*a* and 12*b* are integrated, the right ends in FIG. 1 may contact the outside reinforcing plate 20 secured to the inside of said outside exhaust muffler piece 12*b* and to be like strong tubes provided within respectively with bolt inserting holes 21 and 22. Said reinforcing plates 16 and 20 and exhaust muffler pieces 12*a* and 12*b* are provided respectively with inserting holes communicating with the bolt inserting holes 21 and 22 of said supporting pillars 14 and 15. As shown in FIGS. 1 and 3, stud bolts 23 and 24 provided to project on both sides of the exhaust port 7 of the above mentioned cylincer 1 are inserted respectively through the respactive inserting holes of the inside exhaust muffler piece 12*a*, respective inserting holes of the inside reinforcing plate 16, respective bolt inserting holes 21 and 22 of the supporting pillars 14 and 15, respective inserting holes of the outside reinforcing plate 20 and respective inserting holes of the outside exhaust muffler piece 12*b* and nuts 25 and 26 are screwed respectively to the tips of respective stud bolts 23 and 24 projected outward from the outside exhaust muffler piece 12*b* so that both exhaust muffler pieces 12*a* and 12*b* may be integrally sealed and may be divided by removing the above mentioned nuts 25 and 26.

Needless to say, the above mentioned supporting pillars 14 and 15 need not be formed to act to divide and integrate both exhaust muffler pieces 12*a* and 12*b* as in the embodiment in the drawings. In such case, for example, both exhaust muffler pieces 12*a* and 12*b* may be provided at one side end with a latch type clamp (not illustrated) and at the other side end with a hinge (not illustrated) so as to be dividable and integratable.

Also, in the drawings, the reference numeral 27 represents a substantially cylindrical tubular member holding a cloth catalyst 29 between such holding screens 28 as stainless steel screens. That is to say, in the embodiment in the drawings, one metal screen 28 is doubly spirally rolled, the cloth catalyst 29 is inserted between the first lap and second lap, the whole is made substantially cylindrical and said metal screen 28 is jointed in the lapped part 31 at the ends by a spot welding or by such other means as a clamp.

By the way, for said holding screen 28 can be used, for example, a stainless steel screen. The wire diameter and mesh can be properly selected. The above mentioned cloth catalyst 29 is such oxidizing catalyst deposited on a cloth-like substrate as, for example, an article (made by forming a thin carrier layer of silica or alumina on the surface of ceramics and carrying a small amount of platinum or palladium as a catalyst metal at a high dispersion in the carrier layer) called PANA-CLOTH PURE produced by Matsushita Electric Industrial Co., Ltd.

By the way, in the embodiment in the drawings, as described above, one metal screen 28 is doubly spirally rolled and the cloth catalyst 29 is inserted between the first lap and second lap. However, one metal screen 28 may be triply or quadruply rolled and the cloth catalyst 29 may be inserted not only between the first lap and second lap but also between the second lap and third lap. By thus increasing the number of rolls, the contact area of the catalyst with the exhaust gas can be simply increased without increasing the volume of the entire muffler to be advantageous in improving the oxidizing efficiency, that is, the exhaust gas cleaning efficiency by the catalyst.

By the way, the above mentioned tubular member 27 may be formed by inserting the cloth catalyst between two metal screens, rolling them and jointing the lapped parts at the ends. Also, in this case, two metal screens holding the cloth catalyst between them may be rolled not only once but also doubly or triply to increase the number of rolls.

Figure 2:
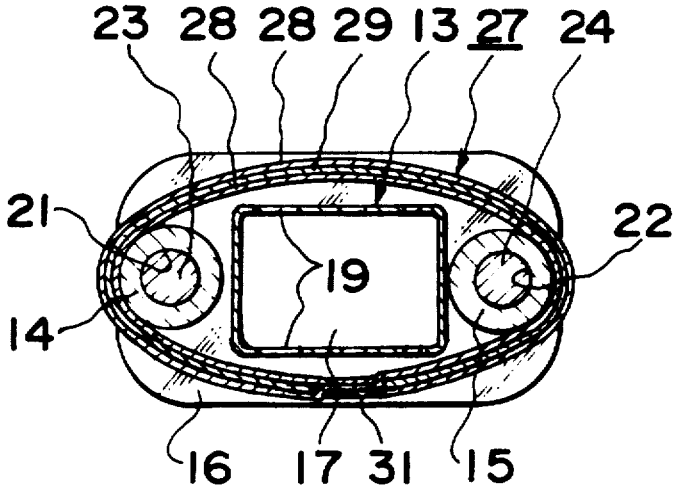
FIG. 2 is a sectioned view as seen in the direction indicated by the arrows II—II in FIG. 1.
Figure 4:
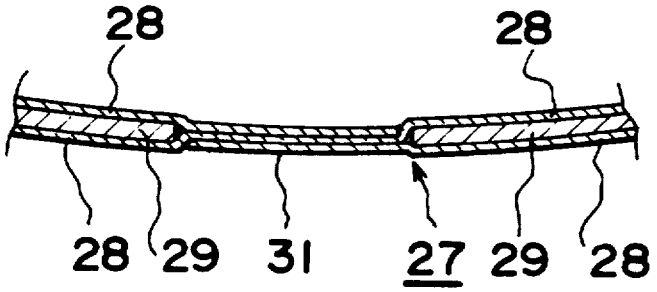
FIG. 4 is an enlarged sectioned view as seen at a point indicated by the arrow IV in FIG. 3.

Then, the above mentioned tubular member 27 is deformed to be substantially elliptically tubular and is hung between said pair of supporting pillars 14 and 15 so as to enclose said exhaust gas introducing tube 13 as shown in FIGS. 1 and 2. By the way, the movement in the axial direction (horizontal direction in FIG. 1) of the above mentioned tubular member 27 is prevented by the contact with the above mentioned reinforcing plates 16 and 20.

By the way, in FIG. 1, the reference numeral 30 represents a discharge pipe.

According to the exhaust muffler B relating to the present invention of the above mentioned formation, the exhaust gas generated by the operation of the engine will be delivered into the exhaust gas introducing tube 13 within the exhaust muffler B from the exhaust port 7 of the cylinder 1 of said engine, will pass through the small holes 19 of the exhaust gas introducing tube 13 and further through the cloth catalyst 29 of the tbular member 27 to be silenced and cleaned and then will be finally discharged out of the discharge pipe 30.

As the cloth catalyst 29 is held between the holding screens 28, it will be reinforced by these holding screens 28 without having the contact area with the exhaust gas greatly impaired and will be able to well endure in the strength to the energy of the exhaust gas.

Also, the above mentioned tubular member 27 will be supported on the above mentioned pair of supporting pillars 14 and 15 by the restoring force by the elastic deformation of the holding screen 28 and will be therefore very easy to fit and remove and simple to clean and replace. That is to say, the cloth catalyst 29 can be very easily fitted, removed and replaced together with said tubular member 27.

Further, as the above mentioned tubular member 27 is supported on a pair of supporting pillars 14 and 15 as described above, it will not be necessary to provide any other particular fastening part or the like in order to fit said tubular member 27 and the structure will be simple and cheap.

Furthermore, the above mentioned tubular memmber 27 can be made, for example, by spirally rolling one holding screen 28, inserting the cloth catalyst 29 between the fisrt lap and second lap, making the whole substantially cylindrical and jointing said holding screen 28 at the ends, may be hung over the pair of supporting pillars 14 and 15 as described above and is therefore easy to make.

As explained in detail in the above, according to the present invention, there are effects that the exhaust gas can be effectively cleaned with a cloth-like catalyst provided within the exhaust muffler and the cloth-like catalyst can be supported so as to be well endurable in the strength to the energy of the exhaust gas without having the contact area with the exhaust gas greatly impaired and is easy to fit and remove, simple to clean and replace and further simple and cheap in the structure.

What is claimed is:

1. An exhaust muffler for an internal combustion engine, comprising a separable housing, a porous exhaust inlet tube extending into said housing in communication with the gas outlet from said engine, a pair of supporting pillars positioned parallel to each other along opposite sides of said inlet tube, and a catalytic filer, comprising a cloth substrate containing said catalyst and at least one holding screen rolled into at least a double spiral tube, said filter being disposed over said supporting pillars being spaced so that said filter is deformed to have an elliptical cross section enclosing said inlet tube.

* * * * *